US006312572B1

(12) United States Patent
Katayama

(10) Patent No.: US 6,312,572 B1
(45) Date of Patent: Nov. 6, 2001

(54) ELECTROLYZER

(75) Inventor: Shinji Katayama, Tamano (JP)

(73) Assignees: Chlorine Engineers Corp., Ltd., Tokyo; Tosoh Corporation, Yamaguchi, both of (JP)

( * ) Notice: Subject to any disclaimer, the term of this patent is extended or adjusted under 35 U.S.C. 154(b) by 0 days.

(21) Appl. No.: 09/524,687

(22) Filed: Mar. 14, 2000

(30) Foreign Application Priority Data

Mar. 15, 1999 (JP) ..... 11-067909

(51) Int. Cl.[7] ..... C25B 9/00

(52) U.S. Cl. ..... 204/254; 204/264; 204/268; 204/283; 204/284; 204/288.1; 204/288.3; 204/289

(58) Field of Search ..... 204/254, 268, 204/283, 284, 288.1, 264, 288.3, 289

(56) References Cited

U.S. PATENT DOCUMENTS 5,174,878 * 12/1992 Wullenweber et al. ..... 204/254

* cited by examiner

*Primary Examiner*—Bruce F. Bell
(74) *Attorney, Agent, or Firm*—Armstrong, Westerman, Hattori, McLeland & Naughton

(57) ABSTRACT

The present invention provides an ion exchange membrane type electrolyzer, which comprises electrodes at opposed positions via an ion exchange membrane, spacers are mounted in dot-like arrangement on openings of electrode surface to maintain spacing between the ion exchange membrane and surface of at least one of the electrodes.

8 Claims, 2 Drawing Sheets

ELECTROLYZER

BACKGROUND OF THE INVENTION

The present invention relates to an electrolyzer, and in particular, to an electrolyzer with electrodes, in which electrolyzing voltage can be reduced by decreasing distance between electrodes.

An electrolyzer comprising an anode and a cathode arranged at opposite positions is widely used in applications such as filter press type electrolyzer.

Filter press type bipolar electrolyzer is used for producing salt, and this is a typical electrolyzing method using the filter press type electrolyzer. In unit electrolyzer used in this filter press type bipolar electrolyzer, thin plates made of materials selected from thin-film forming metal such as titanium, zirconium, tantalum, etc. are molded in pan-like shape and are used as a partition wall on anode side. Partition wall on cathode side is produced from thin plates made of nickel, stainless steel, etc. These partition walls are mounted on an electrolyzer frame. On the partition walls, recesses and projections engaging each other are formed, or two partition walls are connected using a clad material and are integrated.

On anode side and on cathode side of the partition wall, an anode with anode activating coating on it and a cathode with a cathode activating coating containing metal of nickel or platinum family are connected by means such as welding.

Extremely high electric current, i.e. several tens of kA to several hundreds of kA, is normally supplied to the electrolyzer. In this respect, even slight decrease of electrolytic voltage provides surprisingly high effect to reduce the power consumption. Therefore, it is very important to decrease the voltage required for electrolysis.

Among the factors, which exert influence on electrolytic voltage, the decrease of inter-electrode distance is an important factor which contributes to the decrease of electrolytic voltage, and various proposals have been made to decrease inter-electrode distance.

SUMMARY OF THE INVENTION

The present invention provides an electrolyzer, which comprises electrodes arranged at opposed positions, a plurality of openings are provided on surface of at least one of the electrodes, spacers are mounted on said openings, said spacers each comprising a space-maintaining portion and a mounting portion, and each of said spacers is designed in such shape and size that loci of the space-maintaining portion of any of the spacers do not cross each other when the space-maintaining portion is rotated around the mounting portion inserted in the opening.

The present invention provides an electrolyzer as described above, wherein the maximum diameter of a graphic figure formed at an intersection between the mounting portion and a plane in parallel to the electrode surface is shorter than the longer diameter of the opening and longer than the shorter diameter of the opening, and the mounting portion is fixed on the opening by rotating it after it is inserted into the opening.

The present invention provides an electrolyzer as described above, wherein the spacer is designed in button-like shape, and the spacer is mounted on a movable type cathode.

DESCRIPTION OF THE PREFERRED EMBODIMENT

Figure 1:
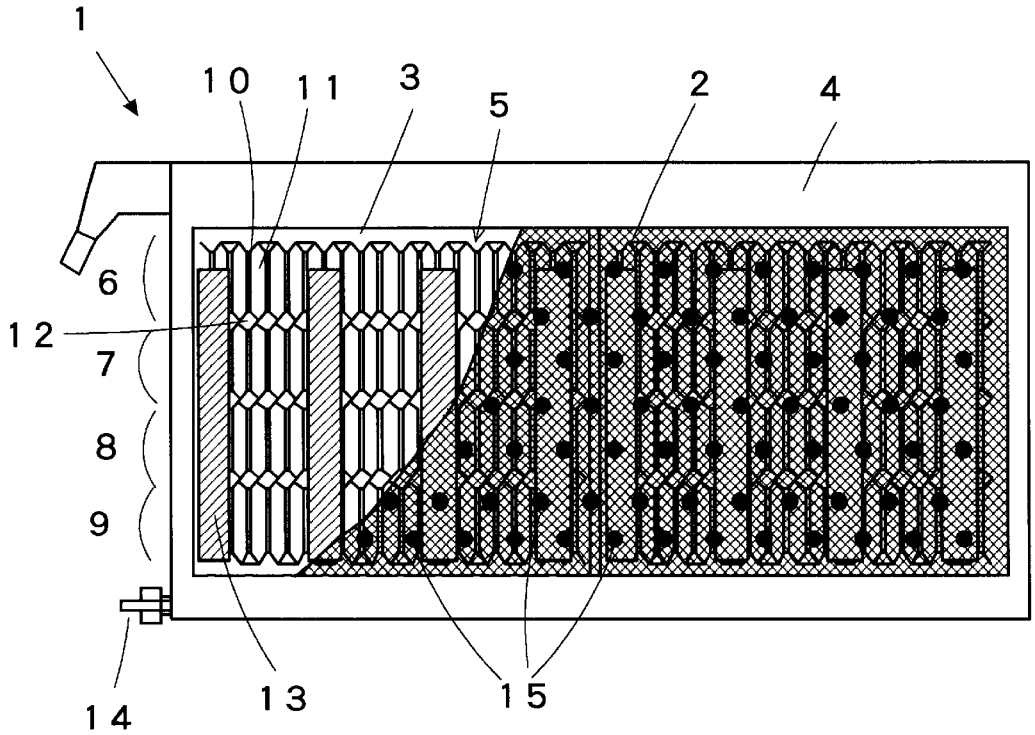
FIG. 1 is a drawing to explain an embodiment of an electrolyzer according to the present invention.

The present invention provides an electrolyzer, by which it is possible to prevent deterioration of an ion exchange membrane caused by contact of the ion exchange membrane with electrodes, or to prevent deterioration of electrodes, which may occur in an ion exchange membrane type electrolyzer having shorter inter-electrode distance.

Description will be given below on the features of the present invention referring to the drawings.

FIG. 1 is a drawing to explain an embodiment of an electrolyzer according to the present invention, and it is a plan view of a unit electrolyzer having a number of spacers in dot-like arrangement on electrode surface in an ion exchange membrane type electrolyzer as seen from the direction of a cathode 2.

The unit electrolyzer 1 is a bipolar type electrolyzer, and the figure shows the unit electrolyzer as seen from the direction of the cathode 2. A partition wall 3 on a cathode chamber of the unit electrolyzer comprises thin plates which are made of stainless steel, nickel, etc. The thin plates are produced by molding, and these are engaged with a partition wall (not shown) on the anode side similarly produced by molding, and it is mounted on an electrolyzer frame 4. On both partition walls inside an electrode chamber 5, there are provided projections and recesses, which are engaged with each other. On the partition walls on anode chamber side, groove-like recesses and projections are formed at such positions as to engage with the projections and the recesses on anode side.

The projections and the recesses divide each of the partition walls into 4 regions: a first region 6, a second region 7, a third region 8, and a fourth region 9 as seen from above. The recesses and the projections in these regions are formed as troughs 10 and ridges 11 extending in top-to-bottom direction of the electrolyzer unit, and a liquid communicating section 12 for communicating adjacent troughs with each other and for communicating troughs in upper and lower regions with each other is formed between each of the adjacent regions. The regions formed in top-to-bottom direction of the electrolyzer unit are not limited to four regions including the first to the fourth regions, but it may be divided to 3 regions or 5 or more regions.

Also, an inner circulation member 13 is provided on the partition wall on cathode side. Between the partition wall and the inner circulation member, a region is formed, into which air bubbles generated at electrodes do not flow. Electrolytic solution with air bubbles removed at the upper portion of the electrolyzer is moved down in the region formed by the inner circulation member, and this promotes circulation of the electrolytic solution and contributes to the homogenizing of the electrolytic solution.

The electrolytic solution is introduced into an electrode chamber 5 from an electrolytic solution outlet on the lower portion of the electrode chamber via an electrolytic solution feeding pipe provided inside the electrolyzer frame 4.

The electrolytic solution is moved up along the troughs in the electrode chamber together with the gas generated in the electrolyzer. It is moved while changing its flow passage from the liquid communicating section to the trough at left or right. In this ascending process, the electrolytic solution is mixed up, and concentration of the electrolytic solution is equalized.

As described above, the recesses and the projections engaging with each other are formed on the partition wall on anode side and on the partition wall on cathode side. These partition walls are superimposed on each other and integrated together to form a partition wall plate. Electrode plates are connected to the projection on the partition wall plate. The recesses and the projections are formed as troughs and ridges extending in top-to-bottom direction of the electrolyzer unit. The recesses and the projections are formed by dividing the electrolyzer unit into a plurality of regions in the direction of height. The trough of each region is positioned on the same straight line as a ridge of another region and it is connected to an adjacent trough of the same region and has a liquid communicating section where the trough of the adjacent region is connected. An inner circulation passage where the electrolytic solution is moved down is formed by a partition wall, which has an inclined surface of the trough of the partition wall or a parallel member provided on the inclined surface of the trough of the partition wall as at least a cellular wall. As a result, it is possible to ensure satisfactory circulation of the electrolytic solution in the electrolyzer.

The cathode 2 is connected to the inner circulation member either directly or via a spacer (not shown) by means such as welding. The cathode may be mounted using a spring-like member, which can be adjusted in its position.

Expanded metal, porous plate, etc. may be used as the cathode, and a cathode activating coating containing metal such as nickel, platinum, etc. may be provided on it.

On the surface of the cathode, button-like spacers 15 are mounted on openings formed on the cathode. Even when the ion exchange membrane comes closer from the direction of the anode surface, the distance between the cathode and the ion exchange membrane is maintained, and this prevents contact of the ion exchange membrane with the cathode surface.

Figure 2:
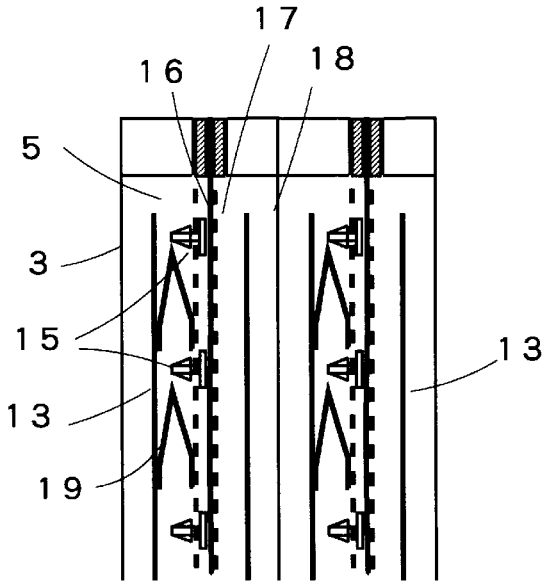
FIG. 2 is a cross-sectional view of a part of an electrolyzer, which comprises unit electrolyzers superimposed on each other via ion exchange membranes.

FIG. 2 is a drawing to show a cross-section of an electrolyzer where unit electrolyzers are superimposed on each other via the ion exchange membranes. It is a partial cross-sectional view.

Spacers 15 are mounted on the cathode 2 and an anode 17 is mounted at opposite position via the ion exchange membrane 16. The cathode is mounted on a spring member 19 having flexibility. As the spring member having flexibility, spring-like member may be used, which is produced by attaching the electrode on blade of a comb-like member and by bending the blade of the comb. By mounting the spring member having flexibility, the space-maintaining portion of the spacer mounted on the cathode surface can be closely fitted to the ion exchange membrane by action of the spring, and spacing between the electrode surface and the ion exchange membrane can be maintained.

Figure 3:
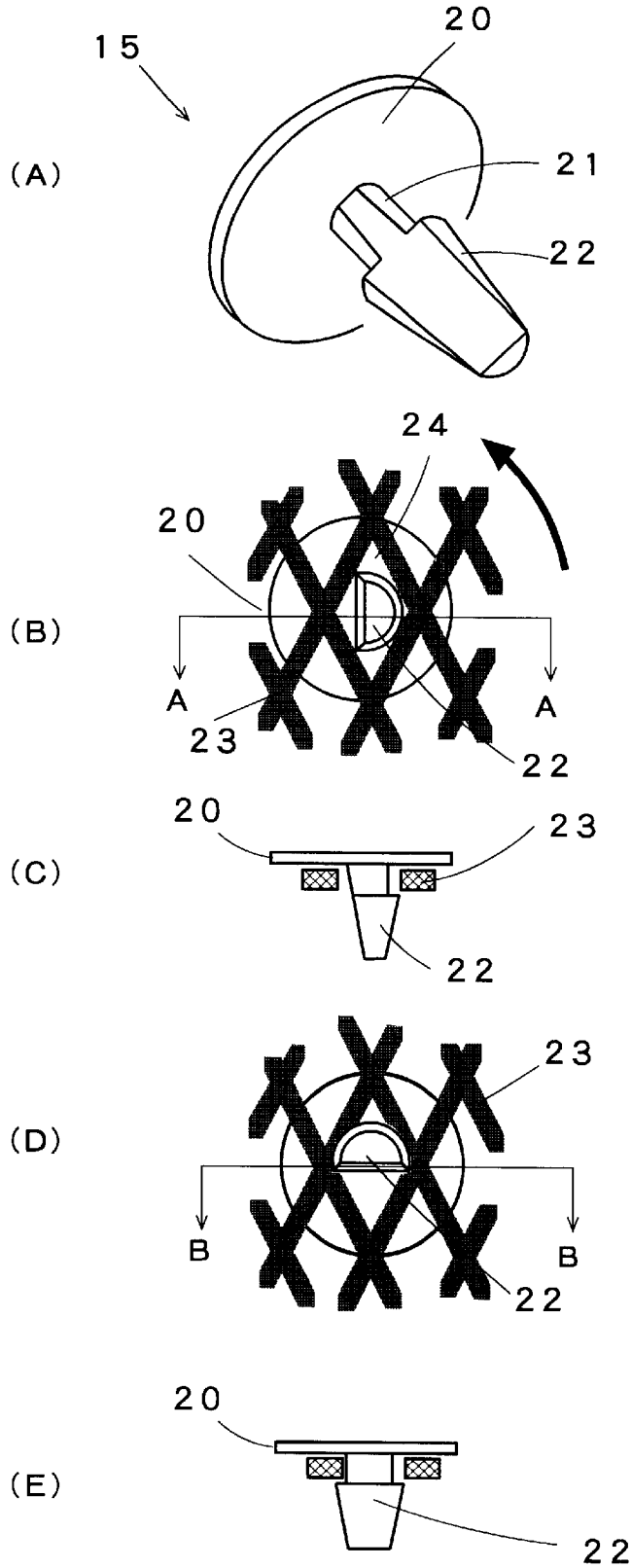
FIG. 3 represents drawings to explain an embodiment of a spacer and a method for mounting the spacer.

FIG. 3 represents drawings to explain an embodiment of a spacer and a method for mounting the spacer. FIG. 3(A) is a perspective view of a spacer 15, which comprises a space-maintaining portion 20 for maintaining spacing between the electrodes at opposite position or between the ion exchange membrane and the electrode surface. The spacer also comprises a mounting portion 21. A part of lateral side of a truncated cone portion 22 is scraped off so that the mounting portion may be easily mounted into a hole formed on the electrode, and this may be used as the mounting portion 21.

FIG. 3(B) is a drawing to explain mounting of the spacer on the electrode surface, and it shows a condition where the spacer is inserted, and it is a view seen from opposite side of the electrode surface. FIG. 3(C) is a view to explain a cross-section, which runs along the line A—A of FIG. 3(B).

In longitudinal direction of a rhombic opening 24 of an expanded metal 23 of the electrode, the truncated cone portion 22 can be inserted with its scraped surface in parallel.

FIG. 3(D) is a drawing to explain the mounting of the spacer on the electrode surface, and it shows a condition where the spacer is fixed. FIG. 3(E) is a view to explain a cross-section, which runs along the line B—B in FIG. 3(D).

The spacer inserted as shown in FIG. 3(B) is rotated at an angle of 90° in arrow direction, and it is fixed using the longest portion of the truncated cone portion on shorter part of the opening 24 of the expanded metal, and this is shown in FIG. 3(D).

As described above, it is possible to facilitate the mounting by designing the mounting portion of the spacer to match the shape of the opening on the electrode surface. Also, it is possible to prevent the spacer from falling off. The space-maintaining portion of the spacer and the mounting portion may be produced separately or these may be integrally molded.

As the material of the spacer, fluoro-resin, polypropylene, polyethylene, etc. may be used.

It is preferable that the space-maintaining portion of the spacer mounted on the electrode surface has a height of 0.2 mm to 3 mm from the electrode surface, or more preferably, 0.5 mm to 1.0 mm.

Also, it is preferable that the spacer is 5 mm to 15 mm in diameter. The shape of the space-maintaining portion of the spacer is not limited to circular shape and it may be designed in square. It can be designed in any shape so far as adjacent spacers are not brought into contact with each other when the mounting portion is inserted into the opening and is rotated.

It is preferable that mounting spacing of the spacer is 50 mm to 100 mm.

In the electrolyzer of the present invention, the spacer may be mounted in any of the electrodes, while it is preferable that a movable type electrode is used, which can be moved by means such as spring, and also that it is used as the electrode positioned opposite to the electrode where the spacer is mounted.

The spacer of the present invention is designed in such manner that it can be perfectly mounted at any desired position over the entire surface of the electrode. Moreover, it is provided in dot-like arrangement. Unlike the spacer provided in net-like or rod-like arrangement, the spacers do not interfere with the flow of the electrolytic solution or the flow of electrolytic current, and this makes it possible to maintain the spacing between the ion exchange membrane and the electrode.

Further, it is possible to arrange many spacers, and this makes it possible to increase the accuracy of the spacing between the ion exchange membrane and the electrode without interfering with the flow of the electrolytic solution.

In the electrolyzer of the present invention, spacers are mounted in dot-like arrangement on the openings on the electrode surface. This makes it possible to reliably maintain the spacing between the ion exchange membrane and the electrode without interfering the flow of the electrolytic solution or the flow of electrolytic current. Further, it is possible to prevent damage of the ion exchange membrane such as deposition of metal compounds in the ion exchange membrane due to ion exchange reaction caused by the contact of the ion exchange membrane with the electrode or formation of pin-holes caused by repeated contact of the ion exchange membrane with the electrode.

What is claimed is:

1. An electrolyzer, comprising electrodes arranged at opposed positions, a plurality of openings provided on the surface of at least one of the electrodes, spacers mounted on said openings, said spacers each comprising a space-maintaining portion and a mounting portion of varying cross-section extending from said space-maintaining portion, and each of said spacers is designed in such shape and size that:

loci of the space-maintaining portion of any of the spacers do not cross each other when the space-maintaining portion is rotated around the mounting portion which is inserted in the opening.

2. An electrolyzer, comprising electrodes arranged at opposed positions, a plurality of openings provided on the surface of at least one of the electrodes, spacers mounted on said openings, said spacers each comprising a space-maintaining portion and a mounting portion, and each of said spacers is designed in such shape and size that loci of the space-maintaining portion of any of the spacers do not cross each other when the space-maintaining portion is rotated around the mounting portion which is inserted in the opening; and wherein the maximum diameter of a graphic figure formed at an intersection between the mounting portion and a plane in parallel to the electrode surface is shorter than the longer diameter of the opening and longer than the shorter diameter of the opening, and the mounting portion is fixed on the opening by rotating it after it is inserted into the opening.

3. An electrolyzer according to claim 2, wherein each spacer is designed in button shape, and the spaces are mounted on a movable cathode.

4. An electrolyzer according to claim 3, wherein the electrolyzer is an ion exchange membrane electrolyzer, comprising an anode, a cathode and an ion exchange membrane.

5. An electrolyzer, comprising electrodes arranged at opposed positions, a plurality of openings provided on the surface of at least one of the electrodes, spacers mounted on said openings, said spacers each comprising a space-maintaining portion and a mounting portion, and each of said spacers is designed in such shape and size that loci of the space-maintaining portion of any of the spacers do not cross each other when the space-maintaining portion is rotated around the mounting portion which is inserted in the opening; and wherein the electrolyzer is an ion exchange membrane electrolyzer, comprising an anode, a cathode and an ion exchange membrane.

6. An electrolyzer, comprising electrodes arranged at opposed positions, a plurality of openings are provided on the surface of at least one of the electrodes, spacers are mounted on said openings, said spacers each comprising a space-maintaining portion and a mounting portion, and each of said spacers is designed in such shape and size that loci of the space-maintaining portion of any of the spacers do not cross each other when the space-maintaining portion is rotated around the mounting portion which is inserted in the opening, wherein each spacer is designed in button shape, and the spacers are mounted on a movable cathode.

7. An electrolyzer, comprising electrodes arranged at opposed positions, a plurality of openings provided on the surface of at least one of the electrodes, spacers mounted on said openings, said spacers each comprising a space-maintaining portion and a mounting portion, and each of said spacers is designed in such shape and size that loci of the space-maintaining portion of any of the spacers do not cross each other when the space-maintaining portion is rotated around the mounting portion which is inserted in the opening;

wherein the spacer is designed in button shape, and mounted on a movable cathode; and wherein the electrolyzer is an ion exchange membrane electrolyzer, comprising an anode, a cathode and an ion exchange membrane.

8. An electrolyzer according to claim 2, wherein the electrolyzer is an ion exchange membrane electrolyzer, comprising an anode, a cathode and an ion exchange membrane.

* * * * *